United States Patent [19]

Nickipuck

[11] Patent Number: 4,768,405

[45] Date of Patent: Sep. 6, 1988

[54] LOCKING SOCKET WRENCH DRIVE DEVICE

[75] Inventor: Michael F. Nickipuck, Brookfield, Ill.

[73] Assignee: Qualicorp Ltd., Westmont, Ill.

[21] Appl. No.: 45,781

[22] Filed: Apr. 30, 1987

Related U.S. Application Data

[63] Continuation-in-part of Ser. No. 634,775, Jul. 26, 1984, abandoned, which is a continuation-in-part of Ser. No. 260,350, May 4, 1981, Pat. No. 4,480,511.

[51] Int. Cl.[4] ..... B25B 23/16

[52] U.S. Cl. ..... 81/177.85; 403/325

[58] Field of Search ..... 81/177.85, 53.2, 124.4, 81/439, 177.4, 177.2; 279/2 R, 75, 76; 403/365, 367

[56] References Cited

U.S. PATENT DOCUMENTS

| | | | |
|---|---|---|---|
| 1,864,466 | 6/1932 | Peterson | 81/177.85 |
| 2,162,359 | 6/1939 | Rhinevault | 87/177.85 X |
| 2,743,639 | 5/1956 | Lynch | 81/53.2 |
| 3,172,675 | 3/1965 | Gonzalez | 279/2 R |
| 3,455,586 | 7/1969 | Kurtzmann | 403/366 |
| 4,070,932 | 1/1978 | Jeannette | 81/177.2 |
| 4,480,511 | 11/1984 | Nickepuck | 81/177.85 |

*Primary Examiner*—Robert P. Olszewski
*Assistant Examiner*—Maurina Rachuba
*Attorney, Agent, or Firm*—Myers & Ehrlich, Ltd.

[57] ABSTRACT

A socket wrench having an extension and a quick-release mechanism is disclosed.

14 Claims, 3 Drawing Sheets

FIG. 11
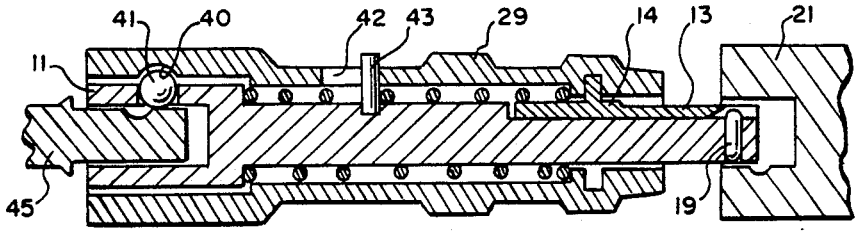
FIG. 12
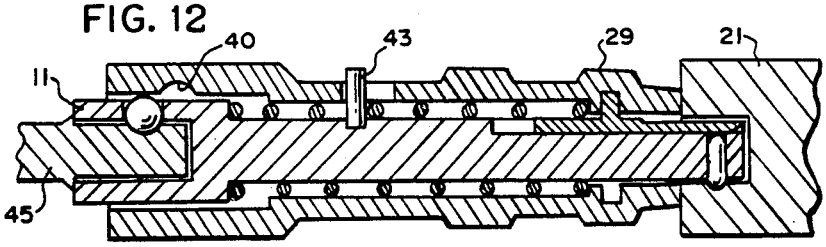
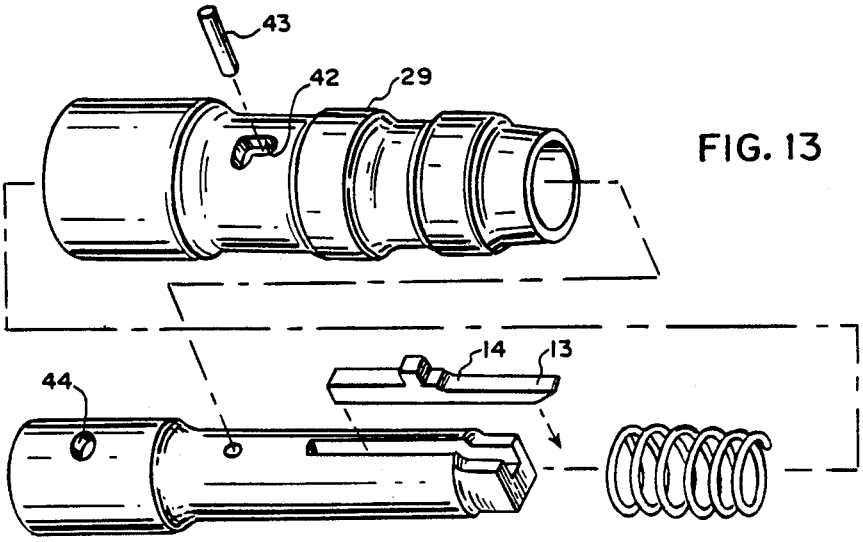
FIG. 13
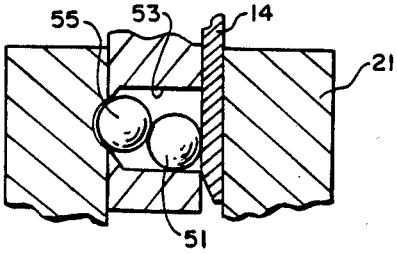
FIG. 14

LOCKING SOCKET WRENCH DRIVE DEVICE

This application is a continuation-in-part application Ser. No. 06/634,775, filed July 26, 1984, abandoned which is a continued in-part of Ser. No. 06/260,350 filed May 4, 1981 now U.S. Pat. No. 4,480,511.

BACKGROUND OF THE INVENTION

Socket wrenches incorporating ratchet drives and standard sockets for driving threaded fasteners including most commonly hexagonal nuts and bolt heads are commonly used in the mechanic's field. In situations where a mechanic is confronted with the requirement for driving a fastener located in a tight space restricting the swing of the drive ratchet handle, extension drives are utilized to transmit the force from the ratchet to the socket. When driving a fastener in a remote location and particularly in a situation where the work must be accomplished in close quarters and with obstructions present, it is desirable to have a mechanism by which the socket can be locked to the extension. In addition to the desirability of a locking feature, it is necessary to provide for the rapid changing of sockets for driving various sizes of fasteners. In the environment in which a mechanic works, for example, in repairing vehicles or machinery, the mechanic often encounters an adverse environment involving temperature variations, corroded or damaged fasteners time pressures regarding the completion of jobs as well as oily and greasy conditions rendering a positive locking and releasing feature desirable. Under these situation, it is deisrable for any mechanism to be simple and reliable as well as durable while providing an effective means of improving the efficiency of the work. Another requirement for mechanic's tools is that they be relatively simple to manufacture and maintain.

Various methods are known by which fastener drive sockets can be affixed to mechanisms with which to drive those sockets. Most of the known systems involve methods tailored to specific needs providing positive locking mechanisms for tools such as impact wrenches, where it is essential from a safety standpoint to have the sockets firmly attached to the drive. In these applications complicated machining may be utilized since the drive mechanisms are of relatively large size and bulk providing adequate strength despite extensive internal machining. In addition, these mechanisms are all devised to be utilized in a location where the operator is provided ample work space and compactness of the mechanism is not an important factor. Known mechanisms incorporate locking means such as external rotating collars which are unsuitable for application in close quarters due to the possibility of accidental release from friction with obstructions (Rhinevault U.S. Pat. No. 2,162,353). Other mechanisms involve plungers as locking mechanisms which must be released utilizing a separate tool (Beers U.S. Pat. No. 2,954,934; Wendling U.S. Pat. No. 2,987,334). Other locking mechanisms involve the use of set screws, pins or other awkward releasing mechanisms requiring the removal of the socket from the fastener or workpiece and preventing rapid releasing of sockets in work in close quarters (Coffman U.S. Pat. No. 2,667,562).

One other type of mechanism known in an application similar to that for the instant invention is a push button release for a ratchet socket drive. This mechanism is unlike the invention in that it requires relatively complicated machining as does the other prior art, is relatively difficult to maintain and subject to malfunction from dirt or wear, is unsuitable for use on extensions because of the utilization of a central axial bore and pushbutton, and finally, involves application of both a downward pressure on a pushbutton plunger while requiring the resistance against which this force is applied as well as the simultaneous movement of the socket in the same direction as the pushbutton and in the direction opposite the resistance, which is an awkward motion for a mechanic in tight spaces. The pushbutton ratchet release also requires that the mechanism be machined out of larger pieces for the same strength as non-machined parts, rendering it frequently difficult to utilize the ratchet and socket combination alone in tight spaces (Smyers U.S. Pat. No. 3,762,245).

The invention provides for the utilization of the locking and quick releasing feature as a supplement to the ratchet handle which may be made smaller yet stronger than the cumbersome quick release type ratchet handle.

SUMMARY OF THE INVENTION

In accordance with the invention, a socket wrench drive extension is designed for use in conjunction with a ratchet drive handle and standard sockets for driving threaded fasteners. The extension incorporates a longitudinal control bar channel machined in one phase of the square drive portion of the socket and extending past the shoulder separating the driven portion from the extension portion of the device. A control bar is incorporated which is slidably mounted within the machined control bar channel, moving longitudinally therein. The lower end of the control bar is machined in the preferred embodiment, being beveled at an angle of approximately 15′–30′ and being narrower at the lower of the control bar. The control bar comprises a flat portion contiguous to the inclined portion. The inclined portion is of a dimension longitudinally such that the lowermost portion of the control bar does not extend past the lower-most portion of the extension drive portion when the control bar is deflected fully forward or downward, while the upper edge of the inclined portion of the control bar at full forward or downward deflection does not extend as far as the bearing menas which transmit the lateral force from the control bar to the detent and thereafter maintaining the socket in locked position until release. When the control bar is at full forward extension the flat portion of the control bar comes in contact with the locking ball bearing thereby locking the detent in position against the wall of the socket and the retainer groove machined therein.

A detent or retainer ball is slidably carried in the transverse aperture of the drive portion of the extension which when in locked position against the locking bearing ball and control bar exerts lateral force against the detent extending past the face in the square drive portion of the extension opposite the face into which the control bar channel is machined. The lateral extension of this detent mates with standard recesses machined in the drive walls of standard sockets and prevents the downward or forward movement of said sockets. The outward extension of the detent further serves to lock the socket in position with relation to the drive axis of the extension in that lateral pressure is exerted on the drive wall of the socket by the detent in its locked position and the control bar along with the opposite face of the drive wall of the socket.

Longitudinal movement of the control bar from the locked to the released position is accomplished by the rearward movement of the sleeve. The rearward force is transmitted to the control bar through the utilization of a spur, or appendage in the control bar from a slidably mounted collar located some distance up the extension from the drive portion of the extension. The rearward motion of the slidably mounted collar is accomplished by moving said collar rearward against the forward spring pressure of the helical spring enclosed by the collar and wound around the body of the extension itself.

The mechanism is maintained in its locked position through the use of a spring exerting forward or downward pressure against the release collar and locked in its forward extension through the use of circular clip ring or clamp.

An additional embodiment utilizes the device herein described with modifications so as to provide for a locking and release action at both the driven end of a socket wrench drive shank and the driving end. In this embodiment, the sliding collar has been rearwardly extended and is of a dimension sufficient to be slidably carried relative to the outside diameter of the driven portion of the placement of a fixedly mounted pin in the surface of the shank, said pin intersecting a generally L-shaped slot in the collar, although other fastening means could be used. The L-shaped slot permits limited forward and rearward travel and limited rotational travel.

The further modification of the sleeve to encompass this embodiment includes the placement of one or more grooves or recesses in the inner surface of the sleeve in the section where it rearwardly extends over the surface of the driven end of the shank. These recesses permit the retraction of a retainer ball placed in said driven end. The recesses are so oriented such that the rotation and rearward movement of the sleeve results in the exertion of inward pressure on the driven end retainer ball or balls. When one driven end retainer ball is oriented so as to compress the customary retainer ball on the driving end of a ratchet wrench or other equivalent driving tool, the shank of the invention is fixedly mounted with respect thereto.

Through the use of this embodiment, the device can function as an adaptor, rather than a mere quick release provision on the end of an extension of a fixed length. In this way the quick release and locking features may be utilized in complete compatibility with a mechanic's existing set of driving tools, particularly with extensions of varied lengths. A further advantage is that the driven end locking feature provides a positive locking action thus avoiding unwanted release of the device itself or the tools attached to the driving end of the device.

Other objects and advantages of this invention will be apparent from the following description, the accompanying drawings, and the claims.

BRIEF DESCRIPTION OF THE DRAWINGS

FIG. 11 constitutes a fragmentary sectional view of the device in its double locking embodiment in the released position.

FIG. 12 constitutes a fragmentary sectional view of the device in its double locking embodiment in the locked position.

FIG. 13 constitutes an exploded view of the device in its double locking embodiment, further demonstrating the method of assembly and disassembly.

FIG. 14 shows an exaggerated sectional view of an alternate embodiment of the device with a retaining ball and a bearing ball in the locked position.

DETAILED DESCRIPTION OF THE PREFERRED EMBODIMENT

Figure 1:
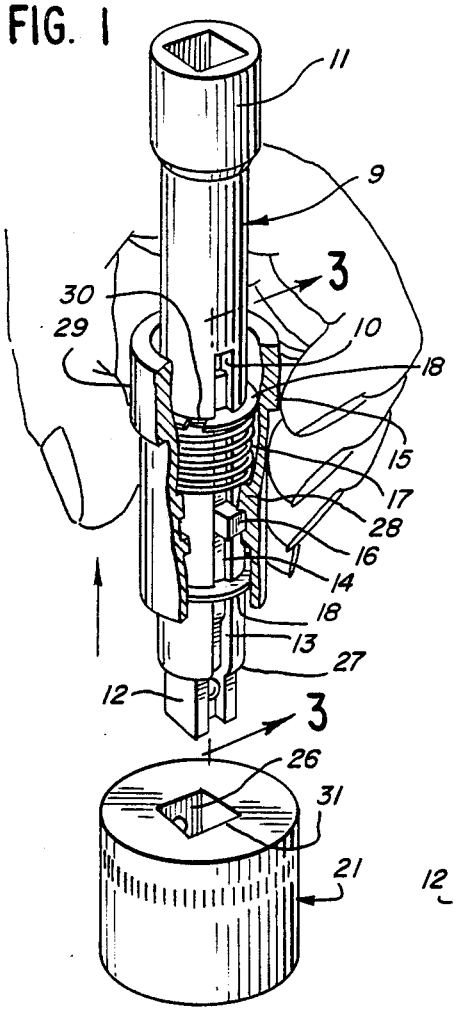
FIG. 1 is a perspective view of the invention and a standard socket in the release position.

The drawings appended hereto illustrate in FIG. 1 a socket wrench drive extension including a driven portion of the socket drive extension 11, the socket wrench drive extension shank 9, and the driving portion of the socket wrench drive extension 12. The socket wrench drive extension is designed to be driven by the square drive portion of a standard ratchet handle mating with the drive portion 11. The socket wrench drive extension 12 drives a standard socket 21 which mates with the driving portion of the socket wrench extension 12.

Machined in the surface of the socket wrench drive extension shank 9 is a control bar channel 10 which channel extends to a substantial portion of the shank 9 through the shoulder 27 between the shank 9 which is cylindrical in cross-section and the driving portion 12 which is square in cross-section. The control bar 14 includes the outer positive locking and centering portion 13 at its lower end. The sleeve engagement spur 16 is an integral part of the control bar 14 which is located equidistant from the end of the control bar and serves to engage the control bar with the sleeve 15.

The sleeve 15 includes internally machined control bar engagement spurs 28 which transmit motion from the sleeve 15 to control bar 14. Internal of the sleeve is a heical spring 17 which bears on the upper portion of the control bar engagement means 28 at the lower end of the spring 17 while being retained by a C-clip 18 fitting a groove 30 machined in the circumference of the drive extension shank 9.

The helical spring 17 is shown in its compressed position in FIG. 1 as the sleeve 15 is pulled axially toward the driven end of the extension shaft 11 and away from the driving end of the extension shaft 12 through a force exerted directionally upward or backward by the user against the grippable portion 29 machined into the exterior of the sleeve. The rearward displacement of the sleeve and connected control bar accomplish the operation as demonstrated in greater detail in FIG. 3 and 4. The control bar release face 25 then releases the ball detent mechanism thereby releasing the standard fastener driving socket wrench 21.

Figure 2:
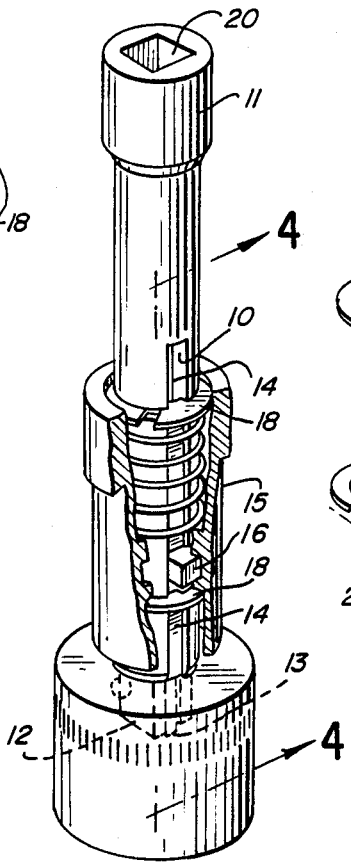
FIG. 2 is a perspective view of the invention and a standard socket in the locked position.

FIG. 2 is a perspective view which shows the preferred embodiment in position for use with the sleeve 15 released by the user and forced downward by the spring 17. As the sleeve 15 is forced downward it in turn forces the control bar 14 downward through the engagement spurs 16 and 28 which displaces the locking mechanism outward and retains the socket 21 in a locked position. The maximum extension of the control mechanism including the sleeve 15, spring 17 and control bar sleeve engagement spur 16 is restricted by a C-clip or circlip 18 fitted in a circumferential groove 30 machined in the shank 9 of the extension drive shaft. In improved embodiments, such as those expressed in FIGS. 10–13, other fastening means can be substituted for C-clips.

Figure 3:
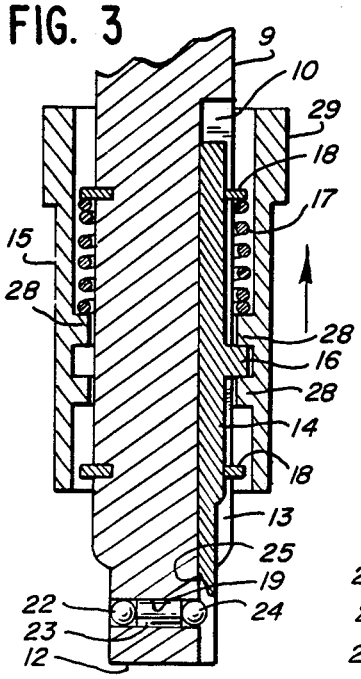
FIG. 3 is a fragmentary sectional view of the invention in its released position.

FIG. 3 is a fragmentary cross-sectional view of the preferred embodiment showing the lower portion of the drive extension shank 9, the square driving portion of the socket wrench drive extension shaft 12. The entire control mechanism, sleeve-bar engagement means 28, bar-sleeve engagement means 16, control bar 14, spring 17 and C-clips 18 as shown in this sectional view.

Also shown in sectional view FIG. 3 is the lower locking portion of the control bar 14 which comprises the outer positive locking and centering portion of the control bar 13, as well as the beveled release surface 25 of the control bar 14. Apparent in this sectional view if the transverse bore 19 positioned in such a way as to intersect the control bar channel 10. This transverse bore 19 is knurled or otherwise machined at either end to decrease the diameter of the bore so as to retain the locking bearing ball 24, the transmission shaft 23 for transmitting the locking force to the retainer ball 22, and retainer ball 24.

FIG. 3 shows the preferred embodiment in the spring-compressed position as in FIG. 1 which permits the retainer mechanism ball bearings 22 and 24, and force transmission shaft 23 free to be displaced radially through the transverse bore toward the control bar channel thereby permitting the removal of the socket.

As can be seen in FIG. 3 the C-clips 18 further serve to provide radial pressure against the outer surface of the control bar 14 to prevent its displacement outward, as does the inner wall of the sleeve 15.

Figure 4:
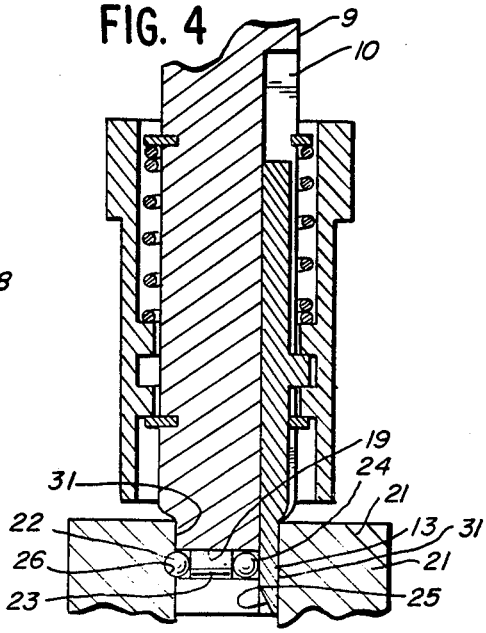
FIG. 4 in a fragmentary sectional view of the invention in its locked position shown in conjunction with a standard socket.

FIG. 4 is fragmentary sectional view showing the feature as described in FIG. 3 as well as the drive socket 21 which includes a recess 25 against which the retainer ball bearing 22 is forced through operation of the control bar.

FIG. 4 shows the spring 17 in its extended configuration forcing the sleeve 15 downward through operation of the engagement spurs 28 and 16 to its maximum extension is restricted by the C-clips 18. Through the operation of the engagement spurs 28 and 16 the control bar 14 is also extended downward to its maximum operating extension point. Through the range of motion of the control bar downward the beveled release surface 25 of the control bar applies constant force accross the ball bearings 24 which through the force transmission shaft 23 extends the retainer ball 22 progressively farther outward on the opposite face the square socket drive portion 12. It is important to have the angle of the beveled release surface 25 and the distance between the widest portion of the beveled surface 25 and the narrowest portion of proper dimensions so as to displace the locking mechanisms far enough to permit the locking of standard sockets by using a dimension appropriate given the standrad dimension of the socket locking depression.

As downward or forwardmost extension of the control bar 14 occurs and outwardmost displacement of the locking mechanism 24, 23 and 22 occurs the flat interface 13 of the control bar 14 prevents further transverse movement of the locking mechanims 22, 23 and 24 by virtue of the fact that the force is acting approximately 90° in relationship to the locking surface of the control bar 32.

The flexibility of C-clips 18 and the clearances between the control bar 14 and the sleeve 15 permit the control bar 14 to move slightly away from the shank 9. In the locked position the control bar 14 is moved slightly away from the shank 9 by the camming pressure of surface 25 against the bearing 24, and as a result the outer surface of the positive locking and centering portion 13 of the control bar 14 is in contact with the inner drive wall 31 of the square drive on the standard socket 21. Because of the positive locking nature of the locking mechanism any downward force on the socket while in the locked position is distributed evenly through the retainer ball 22 force transmittal shaft 23 and locking ballbearing 24 through the positive locking and centering portion of the control ball 13 to provide even forces on opposite inner walls 31 of the square drive of a standard socket which serves to center the socket so that as rotational forces act on the entire mechanism through the socket wrench drive extension shaft these forces are distributed approximately equally on or near each corner of the walls of the driving portion of the socket wrench drive extension shaft 12 and the driven inner walls 31 of the standard socket wrench 21. The centering action is desirable in general to transmit equal rotational forces and in particular in cases where the driven inner walls of standard sockets suffer from wear or being oversized.

Figure 5:
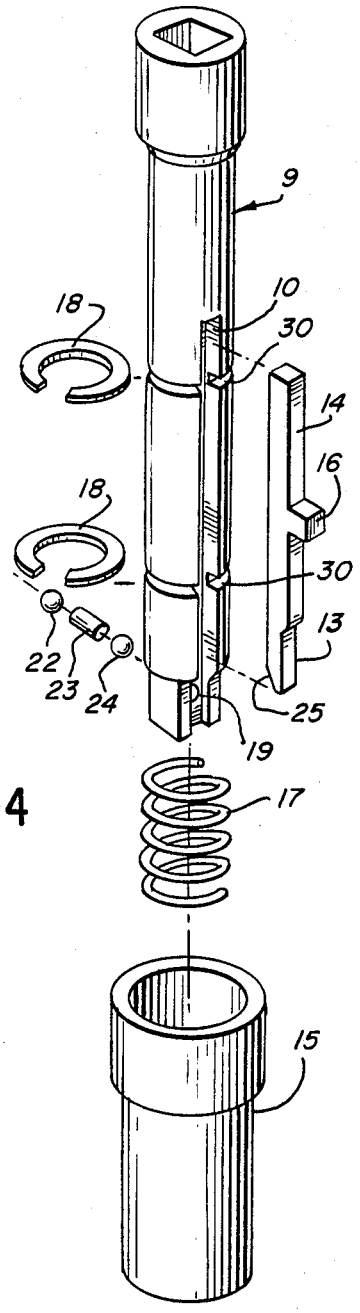
FIG. 5 is an exploded perspective view of the invention showing its parts in relation to each other.

FIG. 5 is a perspective exploded view of the preferred embodiment showing the parts separately in relation to each other.

Figure 6:
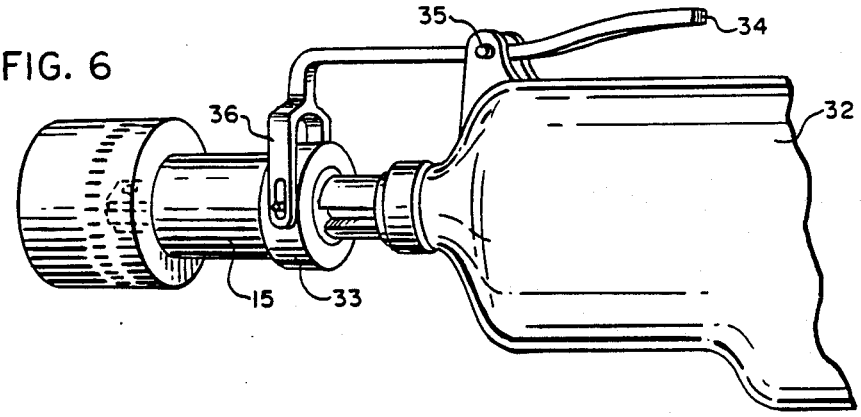
FIG. 6 is a perspective view of the device as adapted to a power socket wrench drive device through the use of a yoke and bearing.

FIG. 6 is a perspective view of an alternative embodiment in which the sleeve 15 is non-rotatably mounted relative to the drive shaft of a power driven socket wrench 32. In this embodiment the sleeve itself is mounted in a rotating bearing 33 through which the downward or rearward force is transmitted through a mechanism pivotally mounted at 35 on the casing of the power driven socket wrench, which mechanism utilizes a semi-circular yoke 36 around the drive shaft and sleeve. The exertion of force on the release lever 34 is transmitted through the bearing to the sleeve which in turn transmits the force through a mechanism as described in FIGS. 1–5 which provides a ready and quick means of releasing said sockets.

Figure 7:
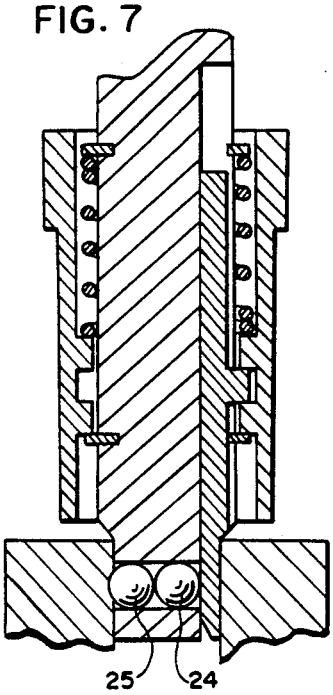
FIG. 7 is a fragmentary sectional view of the device in its embodiment utilizing a retainer ball and single bearing ball.

FIG. 7 is a fragmentary sectional view of another embodiment in which the locking ball bearing 24 bears directly on the retainer ball 25 dispensing with the force transmission shaft.

Figure 8:
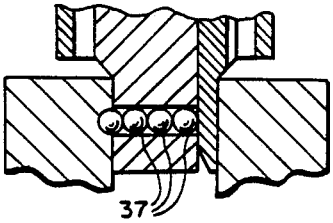
FIG. 8 is a fragmentary sectional view of the device utilizing a multiplicity of ball bearings as force transmittal device.

FIG. 8 is a fragmentary sectional view of another embodiment in which multiple ball bearings 37 are utilized to transmit force from the control bar to the retainer ball.

Figure 9:
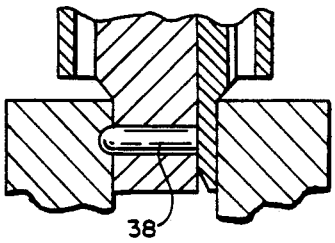
FIG. 9 is a fragmentary sectional view of an embodiment of the device utilizing a single retention member of generally cylindrical configuration.

FIG. 9 is a fragmentary sectional view in which a cylindrical detent 38 is utilized, extending completely through the transverse bore.

Figure 10:
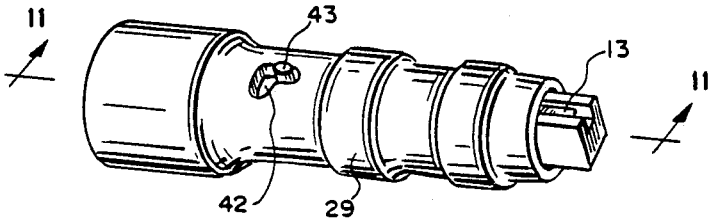
FIG. 10 constitutes a perspective view of the device in its double locking embodiment in the locked position.

FIG. 10 constitutes a perspective view of the device in its double locking configuration. Apparent in FIG. 10 are the common features including the sleeve, 29 and control bar, 14. The sleeve is rearwardly extended over the driven end of the shank. The rearward travel is permitted by and limited by a substantially L-shaped slot, 42, machined through the surface of the sleeve, 29. Retention of the sleeve is accomplished through the use of a pin 43, placed within the slot, 42, and fixedly mounted in the shank.

FIG. 11 is a fragmentary sectional view of the device in its double locking embodiment in the released configuration. The interior of the rearward extension of the sleeve, 29, is provided with a recess or recesses, 40, into which the driven end locking ball, 41 is carried, and permitted to retract in the release configuration. Further apparent is the locking slot 42, and pin, 43. The operation of the driving end section, utilizing the detent, 38, engaging a drive socket, 21, acted upon by the control bar, 14 is substantially the same as the other embodiments.

FIG. 12 is a fragmentary sectional view of the device in its double locking embodiment in the locked configuration. The detent, 38, engages the recess in the socket, 21. The downward or inward pressure of the sleeve 29 is exerted upon the driven end detent, 41 which detent itself mates with the standard detent of the driving member, 45. Because the detent in the driving member 45 is spring loaded, it can be compressed below the driving surface by the locking detent, 41.

FIG. 13 constitutes an exploded view of the device showing the components in a disassembled configuration. Assembly and disassembly is generally accomplished through removal of the retainer pin, 43.

FIG. 14 shows in exaggerated proportions the relationship of a two-ball detent arrangement in the locked position. The bearing ball 51 is supported in passage 53 in the shank 9 and engages the inward surface of control bar 14. Ball 51 engages the wall of the passage 53 and also engages retaining ball 55, forcing retaining ball 55 against the tapered end 57 of passage 53. The passage 53 is somewhat larger in diameter than the balls 51 and 55. As a result, the balls 51 and 55 do not line up and bearing ball 51 takes an eccentric position in the passage 53, as illustrated in FIG. 14. The eccentric position of the ball 51 results in a positive locking relationship between the balls. As the socket 21 is pulled away from the shank 9, a rotative moment is created in the retaining ball 55, tending to rotate ball 55 in a counter-clockwise direction in the view shown. As a result of the eccentric position of ball 51 jammingly pressed adjacent ball 55 the moment is received and transfered to the control bar 14 and the wall of the passage 53, providing enhanced locking action.

I claim as my invention:

1. A wrench apparatus comprising:

a socket member;

an extension structure engaged with the socket member for rotating the socket member;

drive means engaged with the extension structure for rotating the extension structure and the socket member;

said extension structure comprising a shank member supported on the drive means for receiving rotative motion therefrom;

a control bar member supported on the shank member for longitundinal movement and generally radially outward movement with respect thereto between a locked position and a release position;

the socket member having a pair of opposing inner wall portions defining an opening in the socket member therebetween, said opening as defined by said inner wall portions receiving a portion of the shank member;

one of the inner wall portions of said socket member having a securement recess therein communicating with the opening in the socket member;

detent means supported on the shank member for movement with respect thereto into and out of the securement recess for selectively securing and releasing said shank member in said opening in said socket member; and said control bar member having an outward surface facing generally away from the shank member and an inward surface facing the shank member and being angled with respect to the longitudinal axis of the shank member;

said inward surface of the control bar member cammingly engaging the detent means when the control bar member is moved into the locked position to move said detent means into said securement recess for securing the socket member in engagement with the shank member;

the control bar member moving generally radially outwardly from the shank member, said outward surface of the control bar member contacting the other of the inner wall portions of the socket member within the opening therein when the inward surface cammingly moves the detent means into the securement recess, whereby the socket member is generally centered on and secured to the extension structure.

2. The invention according to claim 1 and a sleeve member supported on the shank member for longitudinal movement thereon, said sleeve member engaging the control bar member for movement thereof.

3. The invention according to claim 2 and said sleeve member having a biasing means supported thereon biasing the sleeve member to move longitudinally with respect to the shank member toward the socket member, said sleeve member moving the control bar member to cammingly move the detent means into the recess whereby said biasing means biases the extension structure to be in secured engagement with the socket member.

4. The invention according to claim 1 and said shank member having a longitudinal recess receiving the control bar member therein and guiding the control bar member in axial movement with respect to the shank member.

5. The invention according to claim 1 and said shank member having a generally transversely extending passage therein receiving the detent means for transverse movement with respect to the shank member responsive to the axial movement of the control bar member.

6. The invention according to claim 5 and said detent means comprising first and second ball members;

said passage being larger than said ball members whereby when the apparatus is secured to the socket member, the ball members move into an eccentric locking position in which one of the ball members jammingly secures the other of the ball members in locked position.

7. A wrench apparatus comprising:

drive means;

an extension structure having a first portion engaged with the drive means for receiving rotative motion therefrom and a second portion distal to the first portion;

a socket member supported on the second portion of the extension structure;

the extension structure comprising:

a shank member having a recess therein receiving a portion of the drive means;

a sleeve member receiving the shank member therein;

the shank member having an opening therein communicating with the recess and with the sleeve member;

the drive means having a securement recess therein;

detent means supported for movement in the opening in the shank member;

said sleeve member being movable with respect to the shank member between a locked position and a released position;

said sleeve member selectively engaging the detent means and moving said detent means into the securement opening in the drive means when the sleeve member is moved to the locked position for securing the engagement structure to the drive means; and the extension structure having securement means thereon for selectively securing said socket member on the second portion of the extension structure;

the securement means securing said socket member to said second portion when the sleeve member is moved to the locked position, and releasing the socket member to be removed from the extension structure when the sleeve member is moved to the release position, whereby the drive means and the socket member are substantially simultaneously secured by movement of the sleeve member into the locked position and substantially simultaneously released by movement of the sleeve member into the released position.

8. The invention according to claim 7 and said sleeve member having a release recess therein; said detent means extending within the release recess when the sleeve member moved into the released position.

9. The invention according to claim 7 and biasing means engaging the sleeve member and urging the sleeve member into the released position.

10. The invention according to claim 9 and coacting means for securing the sleeve member in the locked position.

11. The invention according to claim 10 and said coacting means comprising retaining means supported on the shank member;

the sleeve member having aperture means including a shoulder portion engageable with the retaining means for securing the sleeve member in the locked position.

12. The invention according to claim 11 and said aperture means having a generally L-shaped opening therein.

13. A socket wrench tool comprising:

drive means;

a socket wrench extension engaged with the drive means for receiving rotational motion therefrom;

said socket wrench having a socket engagement portion;

socket means having opposing walls defining an opening in said socket means, said opening receiving said socket engagement portion therein whereby the socket means receives said rotational motion from the extension;

said extension comprising:

a shank member supported on the drive means and extending generally logitudinally therefrom, and being connected with the socket engagement portion;

said shank member having an outer surface portion;

a control bar supported adjacent said outer surface portion of the shank member;

the outer surface portion having control bar guide means for guiding the control bar in generally longitudinal movement between a lock position and a release position;

control bar retention means engaging the control bar and permitting the longitudinal movement of the control bar with respect to the shank member, said retention means limiting the radially outward movement of said control bar with respect to the shank member to maintain operative interaction of the control bar with the guide means;

said socket means having a securement recess therein communicating with the opening.

detent means supported on the socket engagement portion for selective movement between a locked position where the detent means extends within the securement recess, to secure the socket means on the extension and a release position where the detent is withdrawn from the securement recess to permit removal of the socket means from the extension;

said control bar engaging the detent means and moving said detent means into the locked position thereof when the control bar is moved into the lock position whereby said socket wrench extension allows ready access to said control bar and guide means for maintenance, repair and replacement.

14. The invention according to claim 13, and said guide means including wall means defining an outwardly disposed recess in said shank member receiving the control bar for movement therein.

* * * * *